US005289874A

United States Patent [19]

Kadle et al.

[11] Patent Number: 5,289,874

[45] Date of Patent: Mar. 1, 1994

[54] HEAT EXCHANGER WITH LATERALLY DISPLACED LOUVERED FIN SECTIONS

[75] Inventors: Prasad S. Kadle, Getzville; James N. Athens, Tonawanda, both of N.Y.

[73] Assignee: General Motors Corporation, Detroit, Mich.

[21] Appl. No.: 82,572

[22] Filed: Jun. 28, 1993

[51] Int. Cl.[5] ..... F28D 1/02

[52] U.S. Cl. ..... 165/152; 165/153

[58] Field of Search ..... 165/152, 153

[56] References Cited

U.S. PATENT DOCUMENTS

| | | | |
|---|---|---|---|
| 1,974,595 | 9/1934 | Askin | 165/153 |
| 3,298,432 | 1/1967 | Przyborowski | 165/153 |
| 3,993,125 | 11/1976 | Rhodes | 165/153 |
| 4,328,861 | 5/1982 | Cheong et al. | 165/153 X |
| 4,693,307 | 9/1987 | Scarselletta | 165/152 |

*Primary Examiner*—John Rivell
*Assistant Examiner*—L. R. Leo
*Attorney, Agent, or Firm*—Patrick M. Griffin

[57] ABSTRACT

A radiator (10) has tubes (14) and fins (15). The fins (15) have louvered sections (30) laterally aligned with a layer (20), and louvered sections (40), (42), and (46) misaligned from the layers. The louvered sections (40) and (42) are spaced from the louvered sections (30) to form a plain non-louvered section (44) therebetween.

14 Claims, 5 Drawing Sheets

HEAT EXCHANGER WITH LATERALLY DISPLACED LOUVERED FIN SECTIONS

TECHNICAL FIELD

The field of this invention relates to tube and fin heat exchangers and more particularly to louvered fin arrangements therefor.

BACKGROUND OF THE DISCLOSURE

Heat exchangers of the type used for radiators in vehicle engine cooling systems or condensers in vehicle air conditioning systems utilize tubes carrying a coolant or refrigerant requesting that need to be cooled. The heat exchanger also commonly has fins, also called air centers, interposed between the tubes to effectively increase the contact with air for heat transfer to the air. The impetus for increasing the efficiency of heat exchangers is dictated by the need for more fuel efficient and aerodynamic motor vehicles.

The aerodynamic shape of many motor vehicles dictate that the hood line of the motor vehicle be lowered resulting in less space available in the engine compartment particularly in the vertical direction. Two of the largest components in the engine compartment are the radiator and condenser. The lower hood lines dictate for radiators or condensers with less core face area. Any decrease in core face area, overall size and weight of the radiator or condenser must therefor be accompanied by an increase in efficiency for heat transfer for a given air flow.

Often, louvers are incorporated in the fins to improve the heat transfer efficiency. Various fin and louver arrangements have been utilized to increase the heat transfer by increasing the turbulence of air about the fins and tubes. This increase in heat transfer is often accompanied by an undesirable increase in air pressure drop across the heat exchanger. It has also been found that various louver arrangements may be more advantageous than others. U.S. Pat. No. 4,693,307 issued to Scarselletta on Sep. 15, 1987, which is incorporated herein by reference, discloses a heat exchanger with fins having both louvered and non-louvered sections to have both low air pressure drop and high heat transfer performance at a constant air mass flow. U.S. Pat. No. 4,958,681 issued to co-inventor Durgaprasad S. Kadle, which is also incorporated herein by reference, discloses bypass channels positioned near the tube outer surface.

What is needed is an improved louver arrangement which improves efficiency over the teachings of the known prior art.

SUMMARY OF THE DISCLOSURE

In accordance with one aspect of the invention, a heat exchanger includes a plurality of layers of tubes with each layer having a plurality of tubes spaced from each other and with each layer spaced from each other to form a gap therebetween. A folded strip forming a plurality fins is arranged between adjacent pairs of tubes within each layer of tubes. The fins have a first series of louvered sections axially aligned with the tubes of each layer. The fins have a second series of louvered sections interposed between adjacent sections of the first series of louvered sections. Each louvered section of the second series is laterally aligned with the gap between each layer, i.e. is laterally misaligned or displaced with respect to the tubes. Each louvered section of the second series is spaced from adjacent sections of said first series to form plain non-louvered sections interposed between the first and second series of louvers.

Desirably, the heat exchanger further includes a front edge section of the fins extending in front of a front layer of said tubes. The front edge section has a louvered section spaced from the louvered section of the first series aligned with the front layer. A plain non-louvered section is interposed between the louvered section of the front edge section and the louvered section aligned with the front layer.

Desirably, the heat exchanger furthermore has a rear edge section of said fins extending behind a rear layer of said tubes. The rear edge section has a louvered section spaced from the louvered section of the first series aligned with the rear layer. A plain non-louvered section is interposed between the louvered section of the rear edge section and the louvered section aligned with said rear layer. Preferably, the plain non-louvered section laterally spans a side of the tubes.

The combination of the louvered sections of the fin in specific arrangements in combination with other known parameters gives rise to enhanced performance. One of these other parameters are total louvered area not more than 60% and not less than 40% of the total fin area. Another parameter is the thickness and stacked density of the fins is not more than 12% nor less than 2.5% of the space between the adjacent flat tubes. The fin pitch and span is not more than 1.2/mm nor less than 0.68/mm. Pitch and span is defined in detail in the Scarselletta reference.

According to a broader aspect of the invention, a folded strip forming a plurality fins is arranged between adjacent pairs of tubes within at least one layer of tubes. The fins have at least one louvered section laterally aligned with the tubes of at least one layer. The fins have at least one louvered section being laterally misaligned with at least one layer of tubes and being spaced from the laterally aligned louvered section to form a plain non-louvered section interposed between the aligned and misaligned louvered sections.

BRIEF DESCRIPTION OF THE DRAWINGS

Reference now is made to the accompanying drawings in which.

DETAILED DESCRIPTION OF THE PREFERRED EMBODIMENTS

Figure 1:
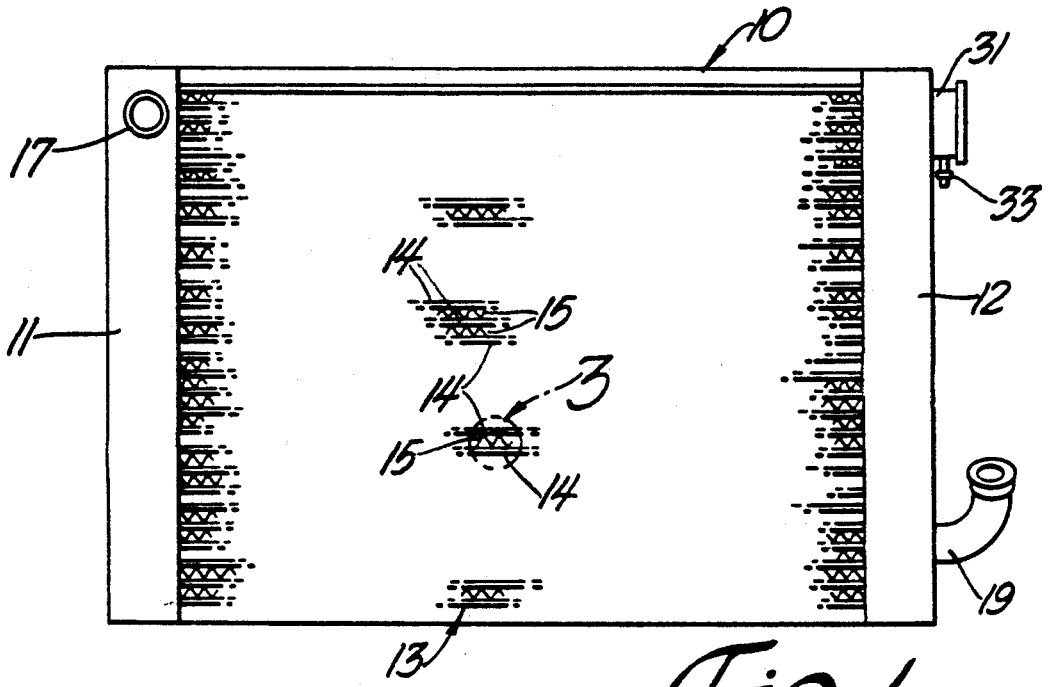
FIG. 1 is a front elevational view of a radiator for a motor vehicle engine cooling system in accordance with the invention.

Referring now to FIG. 1, a radiator 10 used in an engine cooling system of a motor vehicle has a pair of vertically oriented tanks 11 and 12 interconnected by a core 13. The tanks 11 and 12 have an inlet pipe 17 and outlet pipe 19 respectively by which the radiator 10 is connected to the rest of the cooling system. In addition, a fill pipe 31 and overflow pipe 33 are openly connected to let the radiator be filled and allowed to overflow respectively.

Figure 2:
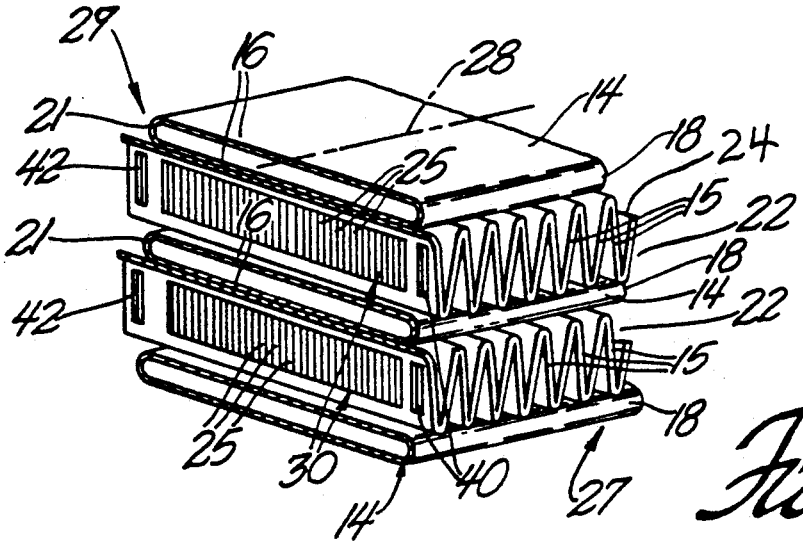
FIG. 2 is an enlarged isometric view of a section of the radiator shown in FIG. 1.

The radiator core 13 has a series of coolant carrying tubes 14 that fluidly interconnect tank 11 with tank 12. The tubes 14 are flattened tubes with top and bottom relatively flat surfaces 16 and two arcuate front and rear edges 18 and 21 as shown in FIG. 2. The tubes 14 are stacked in a vertical layer 20 with the front and rear edges 18 and 21 vertically aligned.

Figure 3:
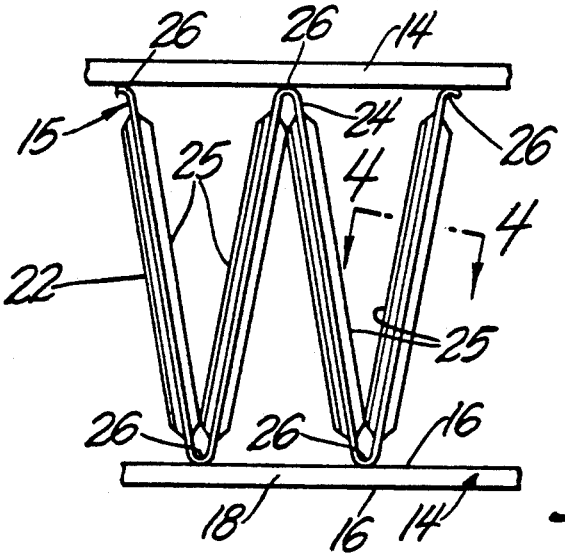
FIG. 3 is an enlarged fragmentary front elevational view of the radiator shown in FIG. 1.

The tubes 14 are vertically spaced apart to form gaps 22 therebetween with fins 15 positioned therein. The fins 15 are also referred to as air centers. As more clearly shown in FIGS. 2 and 3, each fin 15 is part of a corrugated strip 24. Each strip 24 has its crests 26 bonded to an adjacent tube 14. The fin 15 extends from the front 27 of the radiator to the rear 29 thereof at right angles from the longitudinal axis 28 of the tubes. The fin 15 has a plurality of louvers generally indicated as 25 arranged in different sections and at different angles as further described in detail.

Figure 4:
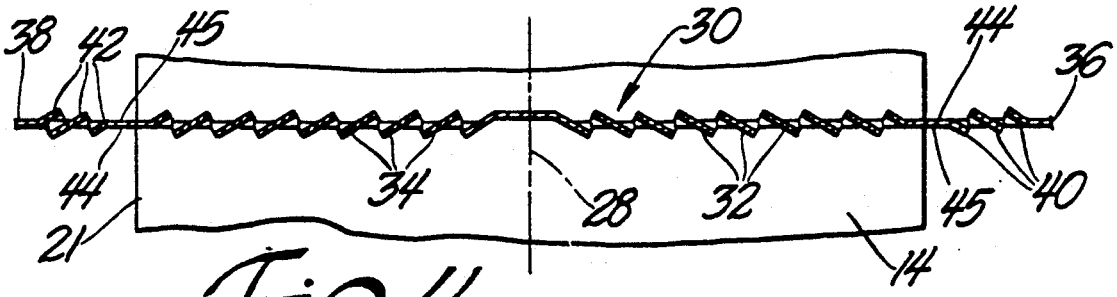
FIG. 4 is cross-sectional view taken along lines 4–4 shown in FIG. 3.

The fin 15 has a louvered section 30 that is laterally aligned with the tubes 14 within layer 20. As more clearly shown in FIG. 4 the louvered section 30 includes louvers 32 that are inclined at an acute angle and are positioned toward the front edge 18 of tube 14 and louvers 34 that have a negative angle and are positioned toward the rear edge 21 of tube 14.

The fin 15 has front edge section 36 that extends in front of tube edge 18 and has a rear edge section 38 that extends behind tube edge 21. The front edge section 36 has a series of louvers 40 that are laterally misaligned from the tube 14, i.e. the louvers 40 are laterally positioned in front of the front edge 18 of tube 14. Similarly, the rear edge section 38 has a series of louvers 42 that are laterally misaligned from the tube 14, i.e. the louvers 42 are positioned behind the rear edge 21 of tube 14.

The series of louvers 40 and 42 are spaced from the louvered section 30 to form plain non-louvered sections 44 interposed therebetween. The plain non-louvered fin sections 44 laterally span the front edge 18 and rear edge 21 of the tube 14. The front edge 18 and rear edge 21 are substantially aligned with the midpoint 45 of a respective plain section 44.

Figure 5:
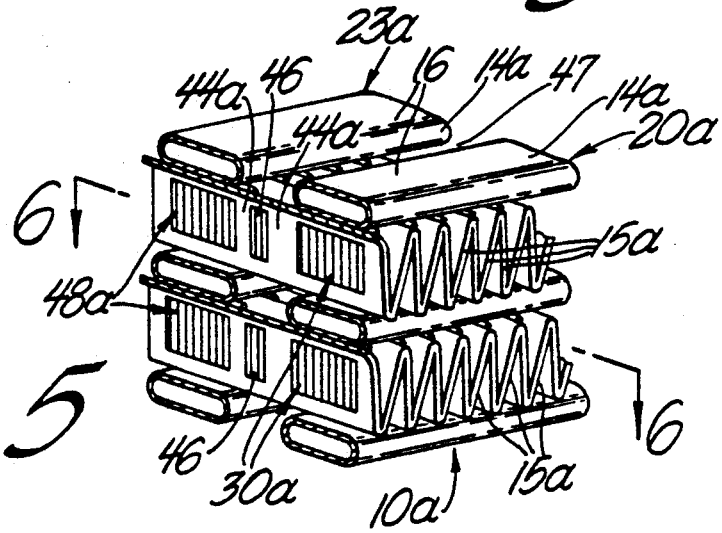
FIG. 5 is an isometric view of a second embodiment of a radiator.
Figure 6:
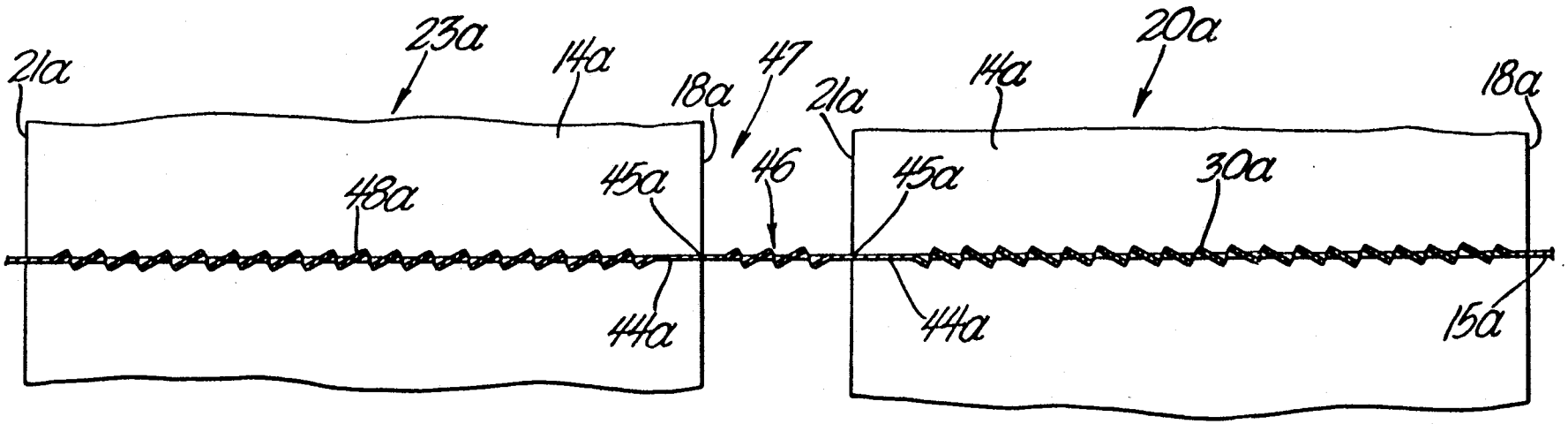
FIG. 6 is a cross sectional view taken along lines 6–6 shown in FIG. 5.

Referring now to FIGS. 5 and 6, a second embodiment of a radiator is illustrated. In the radiator 10*a*, two layers 20*a* and 23*a* of tubes 14*a* are spaced apart with a gap 47 therebetween. The fins 15*a* have a first series of louvered sections 30*a* and 48*a* that are laterally aligned with the respective layers 20*a* and 23*a*. A second series of louvers 46 are laterally misaligned with the layers 20*a* and 23*a*, i.e. the louvers 46 are aligned with the gap 47 between the two layers. The louvers 46 are angled similarly to the louvers in section 48. Louvers in section 30 are oppositely angled. The louver sections 30*a* and 48*a* are spaced apart from louvers 46 to form plain non-louvered sections 44*a* interposed therebetween. The plain non-louvered fin sections 44*a* laterally span either the front edge 18*a* and rear edge 21*a* of a tube 14*a*. The front edge 18*a* and rear edge 21*a* are proximate with the midpoint 45*a* of a respective plain section 44*a*.

Figure 7:
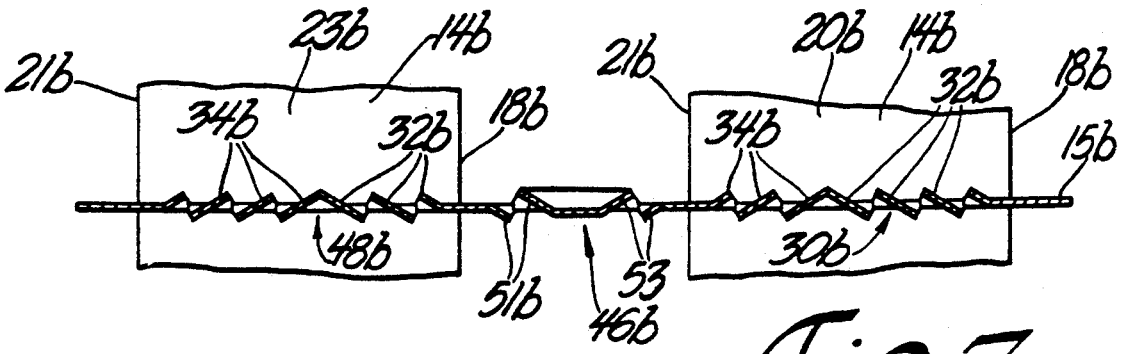
FIG. 7 is a view similar to FIG. 6 illustrating a third embodiment of a radiator.

Reference is now made to FIG. 7 which discloses a variation of the fin arrangement for a radiator having two layers 20*b* and 23*b* of tubes 14*b*. In the variation shown in FIG. 7, the fin 15*b* has louvered section 30*b* and 48*b* wherein each includes louvers 32*b* that are inclined at an acute angle and are positioned toward the front edge 18*b* of respective tubes 14 and louvers 34*b* that have a negative angle and are positioned toward the rear edge 21*b* of tube 14*b*. Similarly, louvered section 46*b* include louvers 51*b* angled similarly to louvers 32*b* and louvers 53 angled similarly to louvers 34*b*. Louvers 53 are positioned forward of louvers 51 within each louver section 46*b*.

Figure 8:
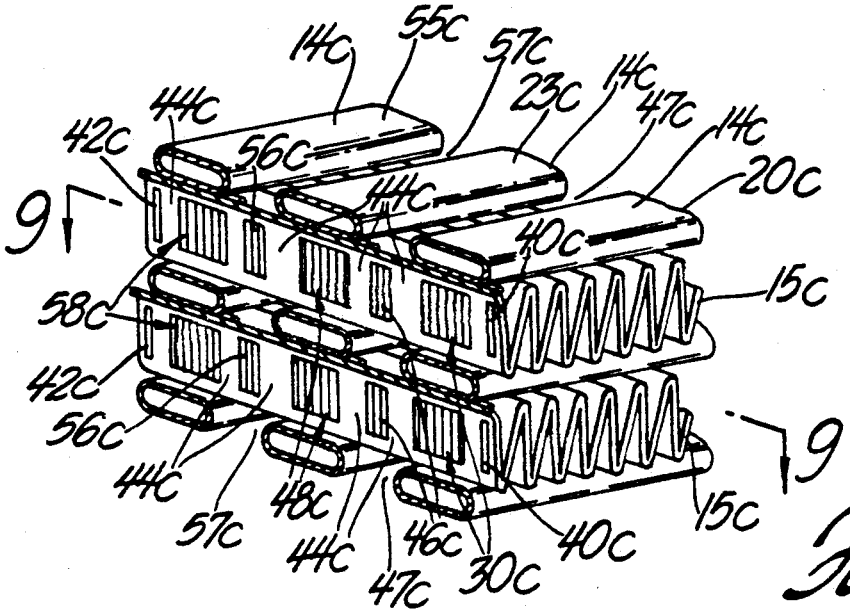
FIG. 8 is an isometric view of a fourth embodiment of a radiator.
Figure 9:
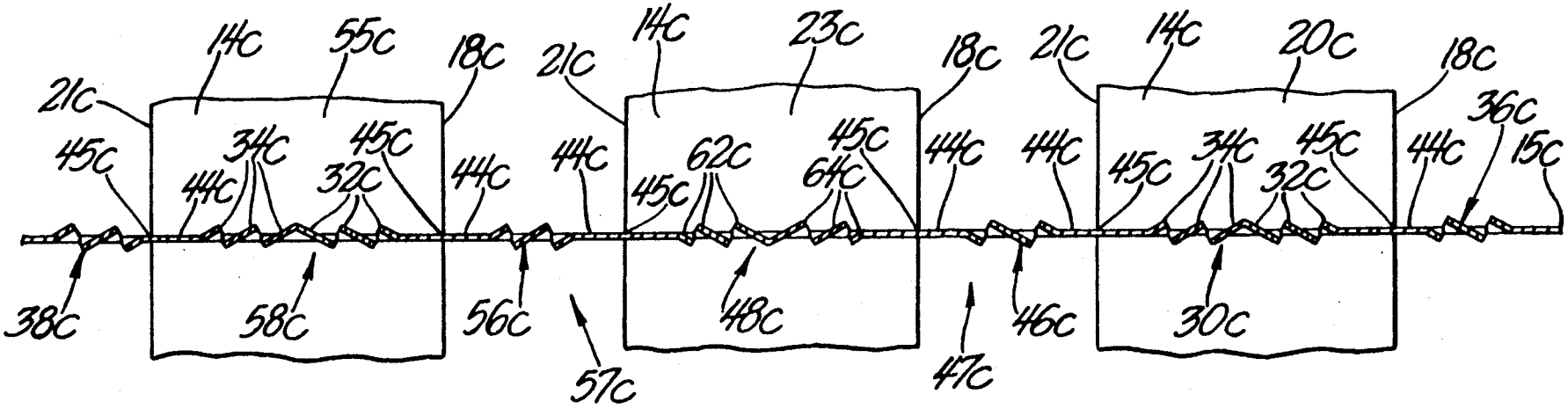
FIG. 9 is a cross-sectional view taken along lines 8—8 shown in FIG. 8.

FIGS. 8 and 9 are now referred to in describing a radiator having three layers 20*c*, 23*c* and 55*c* of tubes 14*c* being spaced apart with gaps 47*c* and 57*c* therebetween. The fins 15*c* have a first series of louver sections 30*c*, 48*c* and 58*c* that are laterally aligned with the respective layers 20*c*, 23*c* and 55*c*. A second series of louvered sections 46*c* and 56*c* are laterally misaligned with the layers 20*c*, 23*c*, and 55*c*, i.e. the louvers 46*c* and 56*c* are aligned with the gaps 47*c* and 57*c* between the two layers. Louvered sections 30*c*, and 55*c* each includes louvers 32*c* that are inclined at an acute angle and are positioned toward the front edge 18*c* of respective tubes 14*c* and louvers 34*c* that have a negative angle and are positioned toward the rear edge 21*c* of tube 14*c*. Similarly, louvered section 48*c* include louvers 62*c* angled similarly to louvers 32*c* and louvers 64*c* angled similarly to louvers 34*c*. Louvers 64*c* are positioned forward of louvers 62*c*. The louvers in section 46*c* are angled similarly to louvers 32*c*. Louvers in section 56*c* are oppositely angled similar to louvers 34*c*. The series of louvers 30*c*, 48*c* and 55*c* are spaced apart from louvered sections 46*c* and 56*c* to form plain non-louvered sections 44*c* interposed therebetween. The plain non-louvered fin sections 44*c* laterally span either the front edge 18*c* or rear edge 21*c* of tubes 14*c*. The front edge 18*c* and rear edge 21*c* are substantially aligned with the midpoint 45*c* of a respective plain section 44*c*.

The louvered section 46*c* has its louvers angled oppositely from the adjacent sets of louvers 34*c* and 62*c* in adjacent sections 30*c* and 48*c* respectively. Similarly, louvered section 56*c* has its louvers angled oppositely from the adjacent louvers 64*c* and 32*c* of sections 48*c* and 55*c*.

The fin 15*c* has front edge section 36*c* that extends in front of tube edge 18*c* and has a rear edge section 38*c* that extends behind tube edge 21*c*. The front edge section 36*c* has a series of louvers 40*c* that are laterally misaligned from the tube 14*c*, i.e. the louvers 40*c* are laterally positioned in front of the front edge 18*c* of tube 14. Similarly, the rear edge section 38*c* has a series of louvers 42*c* that are laterally misaligned from the tube 14*c*, i.e. the louvers 42*c* are positioned behind the rear edge 21*c* of tube 14*c*.

The series of louvers 40*c* and 42*c* are spaced from the louvered section 30*c* to form plain non-louvered sections 44*c* interposed therebetween. The plain non-louvered fin sections 44*c* laterally span the front edge 18*c* and rear edge 21*c* of the tube 14*c*. The front edge 18*c* and rear edge 21c are substantially aligned with the midpoint 45c of a respective plain section 44c.

Figure 10:
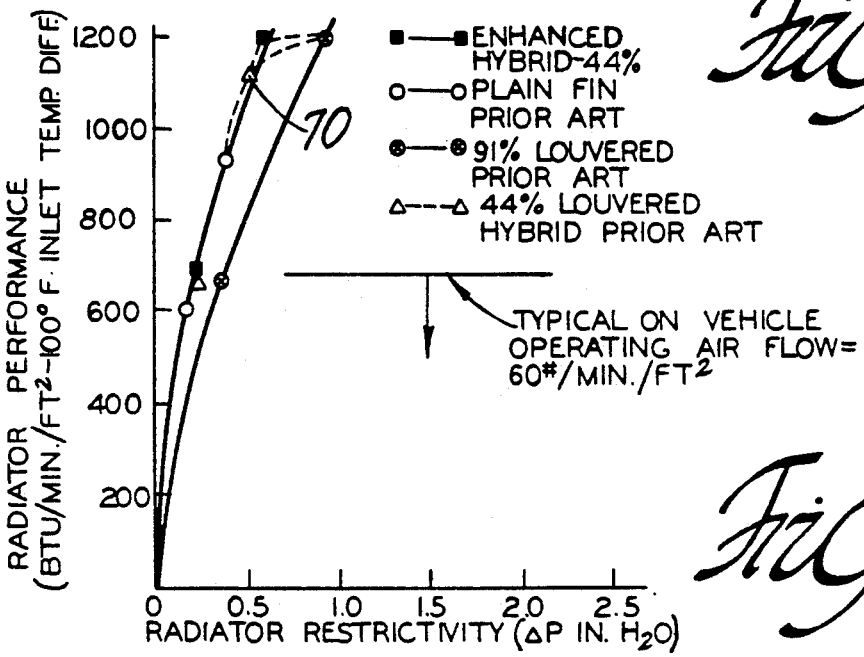
FIG. 10 is a graph illustrating comparative test results for on-car performance of radiators having various louver arrangements on its fins for a three layer radiator as illustrated in FIGS. 8 and 9.

The performance of a radiator constructed in accordance with the above description compares favorably with various radiator constructions of the prior art. As appreciated in the U.S. Pat. No. 4,693,307 issued to Scarselletta, the addition of louvers on the fins increase the heat exchange capacity at the expense of restrictivity of the radiator. Restrictivity is the mechanical energy required to produce an air flow through the radiator. The increase of louver concentration improves heat transfer significantly only till a threshold value. Further increase of louver concentration only improves heat transfer slowly and increases restrictivity very rapidly. A performance versus restrictivity graph plotted for different louver concentrations is shown in FIG. 10 for the radiator construction as shown in FIGS. 8 and 9. The curve plotted for different louver concentrations has a decided "knee" 70 which corresponds to a concentration of louvers set at 44%. As described in the Scarselletta patent, performance increases have been shown for louver concentrations at not less than 40% and not more than 60%.

In accordance with the present invention, while maintaining the louver concentrations as set forth in the Scarselletta patent, heat transfer efficiency can be further enhanced if the louvers are properly positioned as hereinbefore described. The heat transfer capacity for a given radiator of the multi-layer type as illustrated in FIGS. 8 and 9 can be increased to substantially the same level as a heavily louvered fin of the prior art with significantly less restrictivity. Compared to the hybrid louver radiator as taught by Scarselletta, the present invention provides increased heat transfer capability with only an incremental increase in pressure drop that places the plotted point above the previous "knee" that was previously thought to be the maximum curve achievable.

Figure 11:
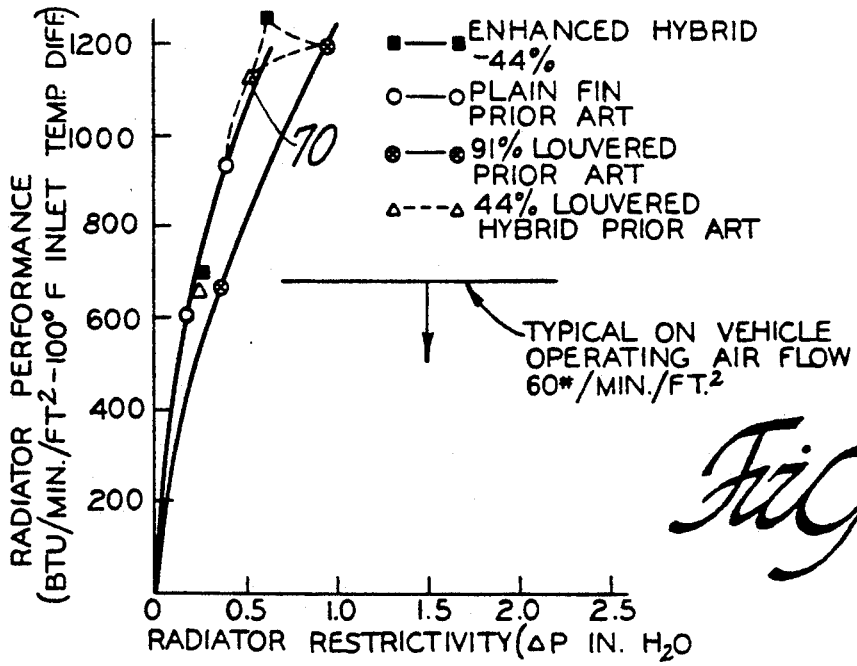
FIG. 11 is a graph illustrating comparative test results for various louver arrangements on the fins of a single layer radiator as illustrated in FIGS. 1 and 2.

The graph illustrated in FIG. 11 for a single layered radiator as illustrated in FIGS. 1 and 2 again pictorially represents the improvement achieved by the louvered sections 40 and 42 as compared to previous single layered radiators. The heat transfer capacity peaks out with the enhanced extended center before dropping down lower for a fully louvered center. The peak occurs because of the existence of a heat sink in the fins that is provided by the plain non-louvered sections 44 aligned with the front edge 18 and rear edge 21 of the tubes 14. The plain non-louvered section 44 provides for increased heat conduction away from the tubes 14 to the edges 36 and 38 of the fins 15. In contrast fully louvered fins loses the conduction path to the edges of the fin and thus, the heat transfer capacity decreases.

The combination of the louvered sections of the fin in the above described specific arrangements in combination with other known parameters gives rise to enhanced performance. One of these other parameters are total louvered area not more than 60% and not less than 40% of the total fin area. Another parameter is the thickness and stacked density of the fins is not more than 12% nor less than 2.5% of the space between the adjacent flat tubes. The fin pitch and span is not more than 1.2/mm nor less than 0.68/mm.

Variations and modifications are possible without departing from the scope and spirit of the present invention as defined by the appended claims.

What is claimed is:

1. A heat exchanger characterized by:

a plurality of layers of tubes with each layer having a plurality of tubes spaced from each other and with each layer spaced from each other to form a gap therebetween;

a corrugated strip forming a plurality fins arranged between adjacent pairs of tubes within each layer of tubes;

said fins having a first series of louvered sections laterally aligned with the tubes of each layer;

said fins having a second series of louvered sections interposed between adjacent sections of the first series of louvered sections, each louvered section of said second series being laterally aligned with said gap between each layer and being spaced from adjacent sets of said first series to form plain non-louvered sections being interposed between said first and second series of louvers.

2. A heat exchanger as defined in claim 1 further characterized by:

a front edge section of said fins extending in front of a front layer of said tubes;

said front edge section having a louvered section spaced from said louvered section of said first series aligned with said front layer; and a plain non-louvered section being interposed between said louvered section of said front edge section and said louvered section aligned with said front layer.

3. A heat exchanger as defined in claim 2 further characterized by:

a rear edge section of said fins extending behind a rear layer of said tubes;

said rear edge section having a louvered section spaced from said louvered section of said first series aligned with said rear layer; and a plain non-louvered section being interposed between said louvered section of said rear edge section and said louvered section aligned with said rear layer.

4. A heat exchanger as defined in claim 3 further characterized by:

said plain non-louvered section laterally spanning an edge of said tubes.

5. A heat exchanger as defined in claim 1 further characterized by:

said fins having a thickness and stacked density such as to constitute not more than about 12% nor less than about 2.5% of the space between the adjacent tubes of each layer, said fins further having a total louvered area not more than about 60% nor less than about 40% of the total fin area, and said fins having a length along their air flow facing edge per unit of area between the tubes divided by said unit area that as measured in millimeters is not more than about 1.2/mm nor less than about 0.68/mm.

6. A heat exchanger as defined in claim 1 further characterized by:

a rear edge section of said fins extending behind a rear layer of said tubes;

said rear edge section having a louvered section spaced from said louvered section of said first series aligned with said rear layer; and a plain non-louvered section being interposed between said louvered section of said rear edge section and said louvered section aligned with said rear layer.

7. A heat exchanger as defined in claim 1 further characterized by:

said plain non-louvered section laterally spanning an edge of said tubes.

8. A heat exchanger characterized by:

at least one layer of tubes having a plurality of tubes being spaced from each other;

a folded strip forming a plurality fins arranged between adjacent pairs of tubes within said at least one layer of tubes;

said fins having at least one louvered section laterally aligned with the tubes of at least one layer;

said fins having at least one louvered section being laterally misaligned with each layer of tubes and being spaced from said laterally aligned louvered section to form a plain non-louvered section interposed between said aligned and misaligned louvered sections.

9. A heat exchanger as defined in claim 8 further characterized by:

said plain non-louvered section laterally spanning an edge of said tubes.

10. A heat exchanger as defined in claim 8 further characterized by:

a front edge section of said fins extending in front of a front layer of said tubes;

at least one louvered section being laterally aligned with said front layer;

one of said at least one misaligned louvered sections being positioned in said front edge section and being spaced from said at least one louvered section laterally aligned with said front layer; and said plain non-louvered section being interposed between said louvered section of said front edge section and said louvered section aligned with said front layer.

11. A heat exchanger as defined in claim 10 further characterized by:

a rear edge section of said fins extending behind a rear layer of said tubes;

at least one louvered section being laterally aligned with said rear layer;

one of said at least one misaligned louvered sections being positioned in said rear edge section and being spaced from said at least one louvered section laterally aligned with said rear layer; and said plain non-louvered section being interposed between said louvered section of said rear edge section and said louvered section aligned with said rear layer.

12. A heat exchanger as defined in claim 11 further characterized by:

said plain non-louvered section laterally spanning an edge of said tubes.

13. A heat exchanger as defined in claim 12 further characterized by:

said fins having a thickness and stacked density such as to constitute not more than about 12% nor less than about 2.5% of the space between the adjacent tubes of each layer, said fins further having a total louvered area not more than about 60% nor less than about 40% of the total fin area, and said fins having a length along their air flow facing edge per unit of area between the tubes divided by said unit area that as measured in millimeters is not more than about 1.2/mm nor less than about 0.68/mm.

14. A heat exchanger as defined in claim 8 further characterized by:

a rear edge section of said fins extending behind a rear layer of said tubes;

at least one louvered section being laterally aligned with said rear layer;

one of said at least one misaligned louvered sections being positioned in said rear edge section and being spaced from said at least one louvered section laterally aligned with said rear layer; and said plain non-louvered section being interposed between said louvered section of said rear edge section and said louvered section aligned with said rear layer.

* * * * *